US006460963B1

(12) United States Patent
Endo

(10) Patent No.: US 6,460,963 B1
(45) Date of Patent: Oct. 8, 2002

(54) BIDIRECTIONAL PRINTING WITH DOT DROPOUT INSPECTION

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 79 days.

(21) Appl. No.: 09/708,467

(22) Filed: Nov. 9, 2000

Related U.S. Application Data

(63) Continuation of application No. PCT/JP00/01413, filed on Mar. 8, 2000.

(30) Foreign Application Priority Data

Mar. 9, 1999 (JP) ..... 11-061843

(51) Int. Cl.[7] ..... B41J 2/12; B41J 2/01; B41J 2/07

(52) U.S. Cl. ..... 347/19; 347/40; 347/41

(58) Field of Search ..... 347/19, 40, 41, 347/16

(56) References Cited

U.S. PATENT DOCUMENTS 5,500,661 A * 3/1996 Matsubara et al. ..... 347/16
6,089,695 A * 7/2000 Takagi et al. ..... 347/40
6,347,855 B1 * 2/2002 Takannaka ..... 347/19

FOREIGN PATENT DOCUMENTS

| | | | | |
|---|---|---|---|---|
| EP | 0783973 | * | 7/1997 | ..... B41J/2/205 |
| JP | 6-226982 | | 8/1994 | |
| JP | 11-988 | | 1/1999 | |
| JP | 2000-15845 | | 1/2000 | |

* cited by examiner

*Primary Examiner*—Huan Tran
(74) *Attorney, Agent, or Firm*—Oblon, Spivak, McClelland, Maier & Neustadt, P.C.

(57) ABSTRACT

Bidirectional normal printing operations are executed wherein forward feeding sub-scan and back feeding sub-scan are alternately carried out between the outward pass and return pass of main scanning. In addition, for each round-trip pass of normal printing operations, determination is made as to whether each nozzle is an operational nozzle, capable of jetting ink droplets, or a non-operational nozzle, incapable of jetting ink droplets, by detection of whether ink droplets are jetted from each nozzle. When a non-operational nozzle is present, supplementary operations are executed wherein dots to have been printed by the non-operational nozzle are printed using another, operational nozzle in a round-trip pass.

13 Claims, 15 Drawing Sheets

SUPPLEMENTARY OPERATIONS IN THE FIRST EMBODIMENT

FLYING INK INSPECTION METHOD (2)

DIAPHRAGM DETECTION METHOD

PRINTING PROCESSING OF THE FIRST EMBODIMENT (WITH DOT DROPOUT INSPECTION AFTER ONE ROUND-TRIP PASS; NO NOZZLE CLEANING)

NORMAL PRINTING OPERATIONS IN THE COMPARATIVE EXAMPLE

SUPPLEMENTARY OPERATIONS IN THE COMPARATIVE EXAMPLE

VARIANT EXAMPLE OF SUPPLEMENTARY OPERATIONS IN THE FIRST EMBODIMENT

PRINTING PROCESSING OF THE SECOND EMBODIMENT (WITH DOT DROPOUT INSPECTION BEFORE ONE ROUND-TRIP PASS; NO NOZZLE CLEANING)

SUPPLEMENTARY OPERATIONS IN THE THIRD EMBODIMENT
(NON-OPERATIONAL NOZZLE IS RESTORED BY CLEANING)

PRINTING PROCESSING OF THE FOURTH EMBODIMENT (WITH DOT DROPOUT INSPECTION BEFORE ONE ROUND-TRIP PASS; WITH NOZZLE CLEANING)

BIDIRECTIONAL PRINTING WITH DOT DROPOUT INSPECTION

CROSS-REFERENCE TO RELATED APPLICATIONS

This application claims benefit of priority under 35 U.S.C. §120 to Patent Cooperation Treaty Application No. PCT/JP00/01413, filed on Mar. 8, 2000. This application also claims benefit of priority under 35 U.S.C. §119 to Japanese application No. 11-61843, filed on Mar. 9, 1999.

TECHNICAL FIELD

The present invention relates to technology for jetting ink droplets from a plurality of nozzles so as to print dots on the surface of a printing medium and thereby print images, and more particularly to printing technology utilizing dot dropout inspection that detects whether ink droplets are jetted from each nozzle.

BACKGROUND ART

An inkjet printer prints images by jetting ink droplets from a plurality of nozzles. A print head of an inkjet printer is provided with a large number of nozzles. However, it sometimes happens that, because of an increase in ink viscosity, the ingression of air, or some other cause, one or more nozzles become clogged and unable to jet ink droplets. The clogging of nozzles, by resulting in the dropout of dots from the image to be printed, is a cause of degradation in image quality.

Conventionally, inspection for clogging would be carried out by the printing of a test pattern on printing paper prior to a printing job and by visual inspection of that test pattern by the user. In this Description, the term "a printing job" refers to the entirety of printing operations that are carried out in accordance with a single instruction by a user.

Conventionally, because inspection would be carried out only before a printing job was started, there occurred the problem of failure to achieve the desired image quality because of dot dropout occurring during printing operations.

An objective of the present invention is to provide technology capable of mitigating degradation of image quality when dot dropout occurs during printing operations.

DISCLOSURE OF THE INVENTION

In order to at least partly resolve the problem, the present invention carries out bidirectional normal printing operations wherein forward feeding sub-scan and back feeding sub-scan are alternately carried out between the outward pass and return pass of main scanning. Furthermore, after each round trip pass of printing operations, an inspection for the jetting of ink droplets from each nozzle is carried out to determine whether each nozzle is an operational nozzle, which is capable of jetting ink droplets, or a non-operational nozzle, which is incapable of jetting ink droplets. When a non-operational nozzle is present, a round-trip pass of supplementary operations, wherein dots to have been printed by a non-operational nozzle are printed with another, operational nozzle, are carried out.

By thus supplementing dots using another, operational nozzle when a non-operational nozzle is detected, the degradation in image quality that would otherwise result from dot dropout occurring during printing operations can be mitigated. In particular, because sub-scanning that alternates between forward feeding and back feeding is carried out in normal printing operations, sub-scanning feeding error that may occur in supplementary operations when back feeding is necessary in supplementary operations is roughly equivalent to that occurring in the normal printing operations. As a result, image quality degradation arising from large sub-scanning feeding error can be mitigated.

In addition, it is preferable for the forward feeding sub-scan is carried out by a first feed amount before the outward pass of main scanning in the normal printing operations, and that the back feeding sub-scan is carried out by a second feed amount that is less than the first feed amount before the return pass of main scanning in the normal printing operations. In so doing, because the print head will have moved by the back feeding prior to the return pass of main scanning that, in normal printing operations, is carried out immediately prior to supplementary operations, the sub-scanning feed amount necessary to carry out supplementary operations can be relatively short. Therefore, feeding error in supplementary operations is also kept low.

In addition, it is preferable that forward feeding sub-scan is carried out before an outward pass of main scanning in the supplementary operations, that back feeding sub-scan is carried out before a return pass of main scanning in the supplementary operations; and that forward feeding sub-scan is carried out after a return pass of main scanning in the supplementary operations but before an outward pass of main scanning in the normal printing operations. In so doing, because forward feeding and back feeding are also carried out alternately in supplementary operations, sub-scanning feeding error in supplementary operations can be kept roughly equivalent to that of normal printing operations.

Furthermore, it is preferable for supplementary operations to be operations wherein only dots located on a main scanning line that was to have been printed by a non-operational nozzle are printed using another, operational nozzle. In so doing, it is possible to prevent the degradation in image quality that would result from overprinting of correctly-printed dots located on other main scanning lines.

In addition, when a non-operational nozzle is detected, cleaning of the non-operational nozzle may be carried out before the supplementary operations, and, in the event that a predetermined number of cleanings fails to restore operation of the non-operational nozzle, a first supplementary operation wherein dots to have been printed by the non-operational nozzle are printed by another, operational nozzle may be carried out. In so doing, dot dropout can be resolved even if a predetermined number of cleanings fail to restore nozzle operation.

Moreover, when a non-operational nozzle is restored within a predetermined number of cleanings, a second supplementary operation wherein the restored, now operational nozzle is used to print dots to have been printed by that the non-operational nozzle may be carried out. In so doing, dots that were initially omitted by a non-operational nozzle can be printed by the nozzle that was originally to have printed the dots, thus simplifying dot supplementation.

Furthermore, the present invention can be realized in various configurations including printing methods; printing apparatus; computer program products that implement the printing methods or the functions of printing apparatus; other computer programs; and data signals embodied in a carrier wave including the computer programs.

BEST MODE FOR CARRYING OUT THE INVENTION

A. Apparatus Configuration

Figure 1:
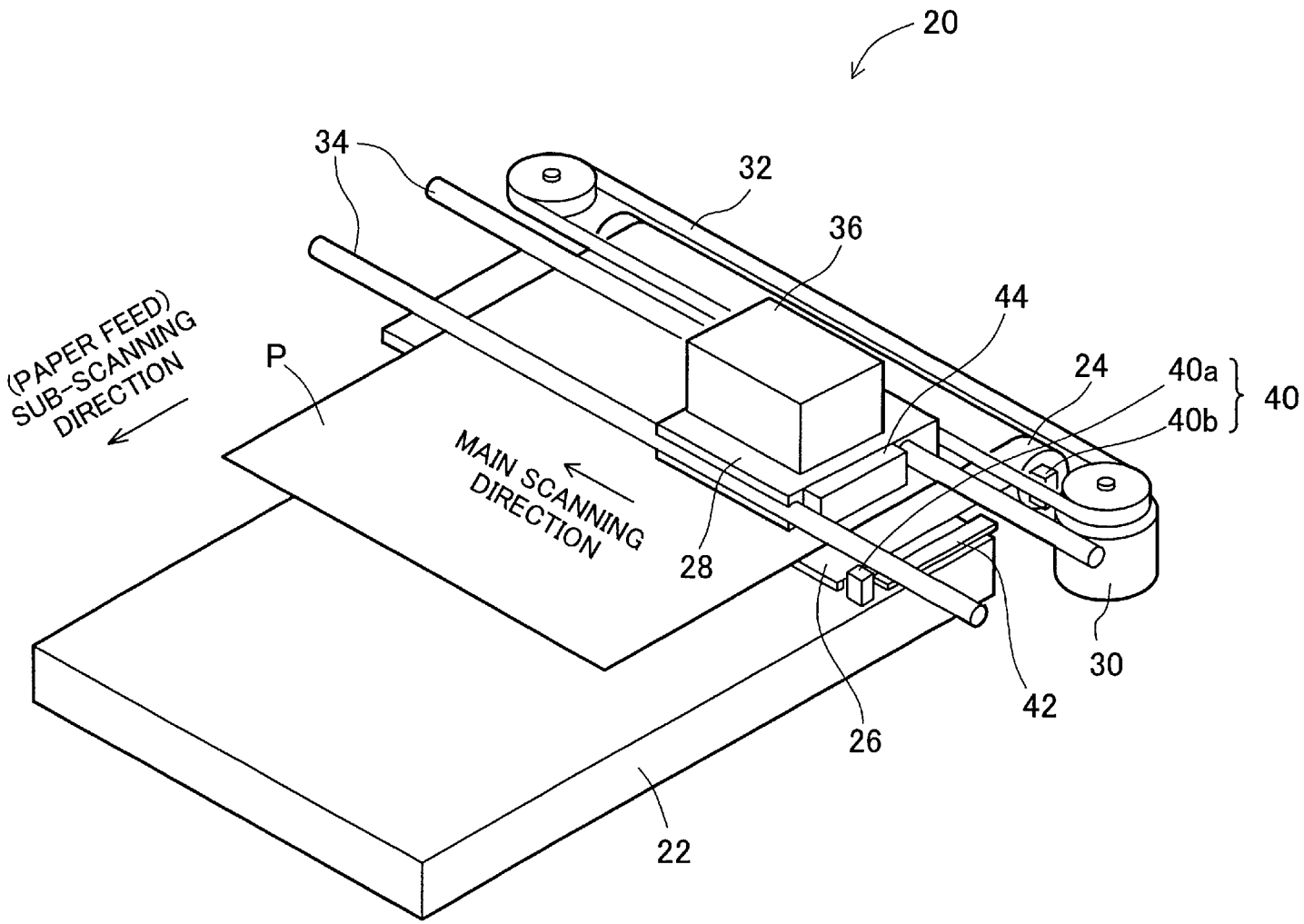
FIG. 1 is a simplified perspective view showing the main configuration of a color inkjet printer 20 embodying the present invention.

Next, a mode for carrying out the present invention is described using embodiments. FIG. 1 is a simplified perspective view showing the main configuration of a color inkjet printer 20 embodying the present invention. The printer 20 comprises a paper stacker 22, a paper feed roller 24 powered by a step motor (not shown), a platen plate 26, a carriage 28, a step motor 30, a drive belt 32 driven by the step motor 30, and a guide rail 30 for the carriage 28. The carriage 28 is provided with a print head 36 having a plurality of nozzles.

Provided at a standby position of the carriage 28, at the far right of FIG. 1, is a first dot dropout inspection unit 40 and a second dot dropout inspection unit 42. The first dot dropout inspection unit 40 is provided with a light-emitting component 40*a* and a photoreceptive component 40*b*. The components 40*a*, 40*b* are used to inspect for dot dropout by detecting the flying of ink droplets. The second dot dropout inspection unit 42 inspects for dot dropout by detecting whether a diaphragm provided at the surface of the second dot dropout inspection unit 42 is made to vibrate by the ink droplets. Inspection by each dot dropout unit is described later in detail.

Printing paper P is taken up from the paper stacker by the paper feed roller 22 and fed over the surface of the platen plate in the sub-scanning direction. The carriage 28, driven by the drive belt 32, which is powered by the step motor 30, moves along the guide rail 34 in the main scanning direction. The main scanning direction is perpendicular to the sub-scanning direction.

Figure 2:
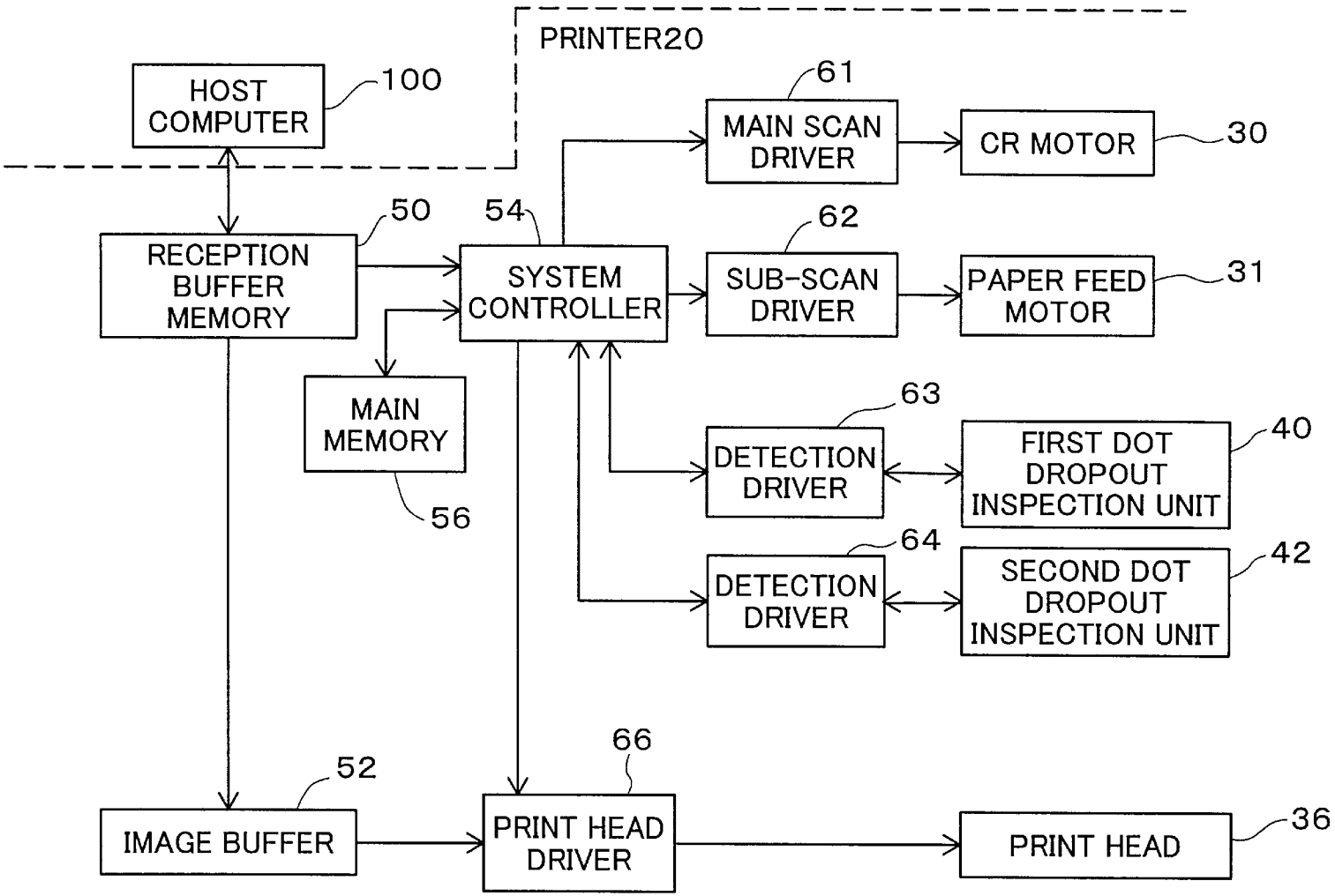
FIG. 2 is a block diagram showing the electrical configuration of the printer 20.

FIG. 2 is a block diagram showing the electrical composition of the printer 20. The printer 20 is equipped with a reception buffer memory 50 that receives signals sent from a host computer 100, an image buffer 52 that stores printing data, a system controller 54 that controls operations of the entire printer, and a main memory 56. The system controller 54 is connected to: a main scanning driver 61 that drives the carriage motor; a sub-scanning driver 62 that drives a paper feed motor 31; inspection unit drivers 63, 64 that drive the two dot dropout inspection units 40, 42; and a print head driver 66 that drives the print head 36.

A printer driver (not shown) of the host computer 100 sets various parameters that determine printing operations in accordance with a printing mode (e.g., rapid printing mode and high-resolution printing mode) specified by a user. The printer driver, also in accordance with the parameters, generates printing data that are used for carrying out printing in the printing mode in question, then transfers the data to the printer 20. Printing data thus transferred is temporarily stored in the reception printer buffer memory 50. In the printer 20, the system controller 54 reads the necessary information that is in the printing data from the reception buffer memory 50 and sends control signals to the drivers in accordance with the information.

The image buffer 52 stores image data for a plurality of color components obtained when the printing data received by the reception buffer memory 50 are separated into the color components. The print head driver 66, in accordance with control signals from the system controller 54, reads the image data for each color component from the image buffer 52 and, in accordance with the data, drives each color's nozzle array provided in the print head 36.

Functions of a normal printing operation execution section, which carries out normal bidirectional printing operations, are carried out by means of the system controller 54, the main scanning driver 61, the sub-scanning driver 62, and the print head driver 66. Further, functions of a supplementary operation execution section, which carry out supplementary operations (described below), are carried out by means of the system controller 54, the main scanning driver 61, the sub-scanning driver 62, and the print head driver 66. Functions of a cleaning execution section, which implements cleaning of the print head 36, are achieved by means of the system controller 54 and the print head driver 66. Computer programs for causing the system controller to carry out the functions of the normal printing operation execution section, supplementary operation execution section, and cleaning execution section are stored in the main memory 56.

B. Configuration and Principle of a Dot Dropout Inspection Unit

Figure 3:
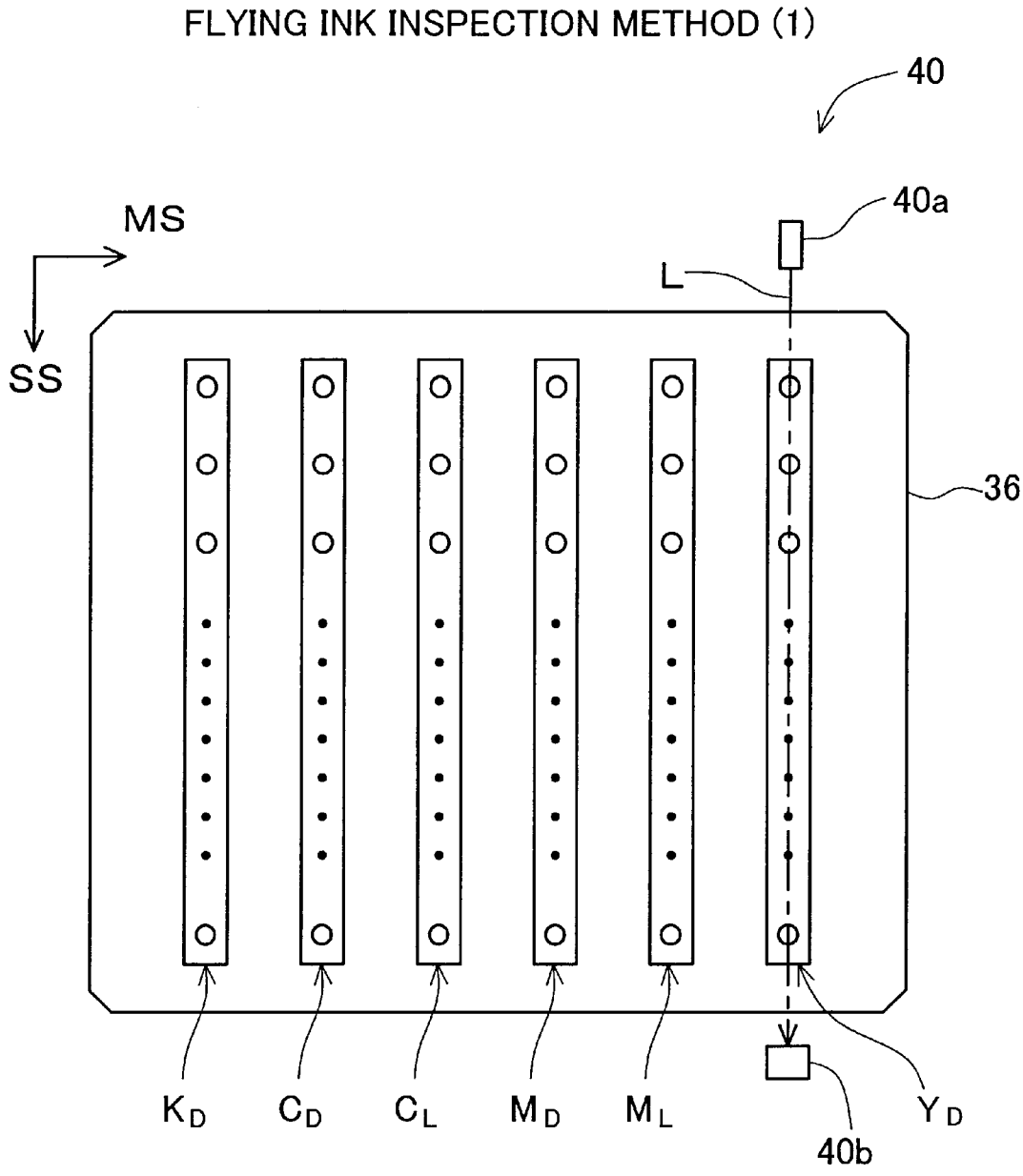
FIG. 3 is an explanatory drawing showing the configuration of a first dot dropout inspection unit 40 and the principle of the inspection method thereof (i.e., the flying droplet inspection method).

FIG. 3 is an explanatory drawing showing the configuration of a first dot dropout inspection unit 40 and the principle of the inspection method thereof (i.e., the flying droplet inspection method). FIG. 3, a view of the print head 36 from the bottom surface side, shows the nozzle array of six colors of the print head 36 and the light-emitting component 40*a* and photoreceptive component 40*b* that constitute the first dot dropout inspection unit.

Located on the bottom surface of the print head 36 are a black ink nozzle group $K_D$ for jetting black ink; a dark cyan ink nozzle group $C_D$ for jetting dark cyan ink; a light cyan ink nozzle group $C_L$ for jetting light cyan ink; a dark magenta ink nozzle group $M_D$ for jetting dark magenta ink; a light magenta ink nozzle group $M_L$ for jetting light magenta ink; and a yellow ink nozzle group $Y_D$ for jetting yellow ink.

The first capital letter in the symbol representing a nozzle group signifies ink color; subscript "$_D$" indicates a comparatively dark ink and subscript "$_L$" a comparatively light ink. Subscript "$_D$" appearing in the symbol of the yellow ink nozzle group $Y_D$ signifies that the yellow ink jetted from that nozzle group assumes a gray color when mixed in approximately equal amounts with dark cyan ink and dark magenta ink. The subscript "$_D$" appearing in the symbol of the black ink nozzle group $K_D$ signifies that the black ink jetted from that nozzle group is not a shade of gray but rather a black color with a darkness of 100%.

The nozzles in each nozzle group are arranged in the sub-scanning direction SS. During printing, ink droplets are jetted from each nozzle as the print head 36 moves in the main scanning direction MS integrally with the carriage 28 (FIG. 1).

The light-emitting component 40*a* is a laser that emits a laser beam L having an outer diameter no greater than 1 mm. The laser beam L is emitted parallel to the sub-scanning direction SS and is received by the photoreceptive component 40*b*. During dot dropout inspection, first, as in FIG. 3, the print head 36 is positioned so as to position the nozzle group for one color (for instance, dark yellow $Y_D$) over the path of the laser beam L. In this state, the nozzles for dark yellow $Y_D$ are, using the print head driver 66 (FIG. 2), driven individually in sequence and each for a predetermined drive period, jetting ink droplets from each nozzle serially. Jetted ink droplets, by temporarily passing through the path of the laser beam L, temporarily interrupt photoreception by the photoreceptive component 40*b*. Therefore, the temporary interruption of reception of laser beam L by the photoreceptive component, the interruption occurring whenever ink droplets are being jetted normally from a given nozzle, can be interpreted as signifying that the nozzle in question is not clogged. Further, the complete absence of the interruption of photo-reception of the laser beam L during the drive period of a nozzle can be interpreted as signifying that the nozzle in question is clogged. In addition, because it may not be possible to determine with sufficient reliability whether the laser beam L has been interrupted based on a single ink droplet, it is preferable for each nozzle to jet a plurality of droplets of ink.

Upon completion of clogging inspection for all nozzles for a single color, the print head 36 moves slightly in the main scanning direction, whereupon inspection of the nozzles for the next color (light magenta $M_L$ in the example in FIG. 3) is carried out.

The above-described flying droplet inspection method offers an advantage of being able to complete inspection in a relatively short amount of time because the method inspects for clogging in nozzles (i.e., for dot dropout) by detecting the absence of flying ink droplets.

Figure 4:
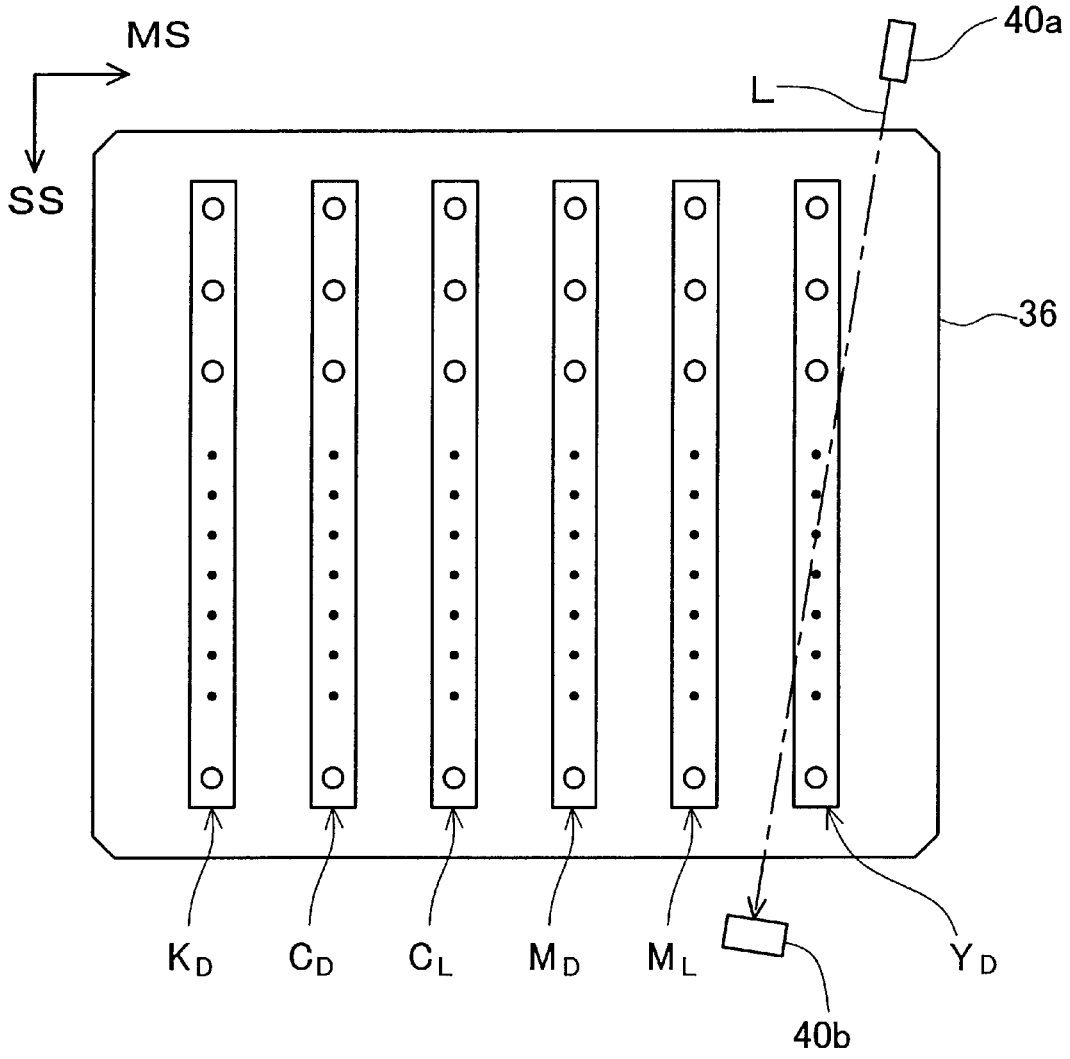
FIG. 4 is an explanatory drawing showing another configuration of the first dot dropout inspection unit 40.

FIG. 4 is an explanatory drawing showing another configuration of the first dot dropout inspection unit. In FIG. 4, the light-emitting component 40*a* and the photoreceptive component 40*b* are oriented so that the travel direction of the laser beam L is somewhat oblique in relation to the sub-scanning direction SS. The travel direction of the laser beam L is set so that when the laser beam is to detect ink droplets from a particular nozzle, the laser beam L is not interrupted by ink droplets from any other nozzles, i.e., so that there is no interference between the laser beam L and the paths of ink droplets from more than one nozzle.

When the laser beam L is emitted in a direction that is at an angle against the sub-scanning direction SS, it becomes possible to detect the clogging of nozzles by driving the nozzles serially to jet ink droplets as the print head 36 moves gradually in the main scanning direction. This manner of detection offers an advantage of enabling detection of the clogging of a nozzle even if the ink droplets jetted from that nozzle deviate slightly from the predefined position or direction.

Figure 5:
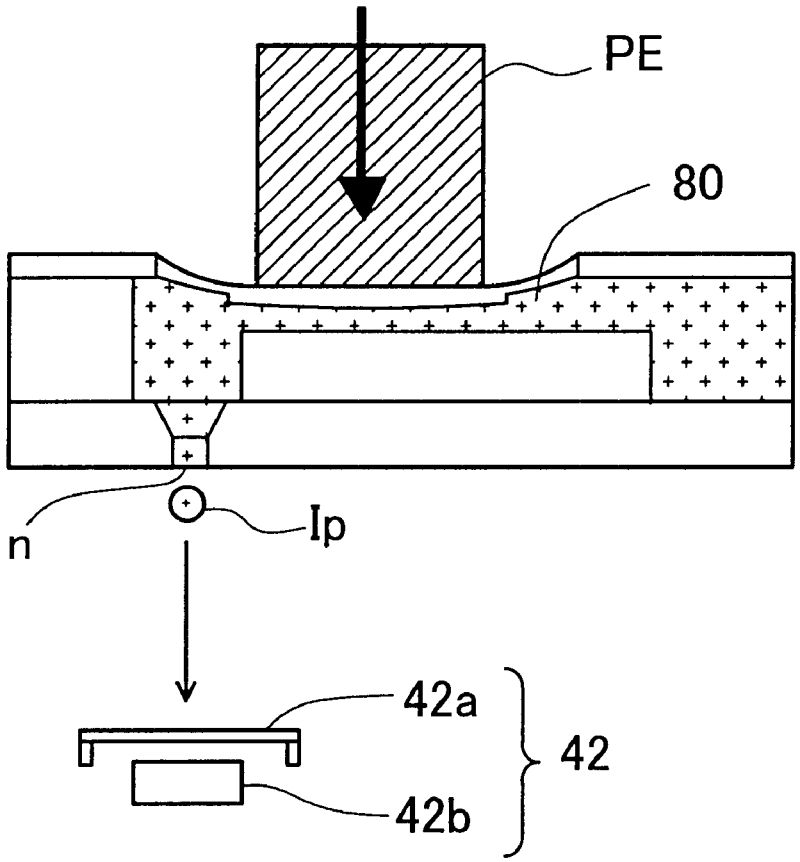
FIG. 5 is an explanatory drawing showing the configuration of a second dot dropout inspection unit 42 and the principle of the inspection method thereof (i.e., the diaphragm inspection method).

FIG. 5 is an explanatory drawing showing the configuration of a second dot dropout inspection unit 42 and the principle of the inspection method thereof (i.e., the diaphragm inspection method). FIG. 5, a cross-sectional view of the vicinity of a single nozzle n of the print head 36, also shows a diaphragm 42*a* and microphone 42*b* that constitute the second dot dropout inspection unit 42.

A piezoelectric component PE for each nozzle n is provided at a position adjoining an ink channel 80 that draws ink to the nozzle n. When a voltage is applied on piezoelectric component P, the piezoelectric component PE elongates, warping one side wall of the ink channel 80. As a result, the volume of the ink channel 80 decreases in proportion to the elongation of the piezoelectric component PE, and an ink droplet lp is jetted from the tip of the nozzle n.

When the ink droplet lp jetted from the nozzle n arrives at the diaphragm 42*a*, the diaphragm 42*a* vibrates. The microphone 42*b* converts the vibration of the diaphragm 42*a* into an electric signal. Therefore, if the output signal (i.e., vibration sound signal) from the microphone 42*b* is detected, it is possible to determine whether or not the ink droplet lp has arrived at the diaphragm 42*a* (i.e., whether or not the nozzle in question is clogged).

In addition, such a combination of diaphragm 42*a* and microphone 42*b* should preferably be aligned in the sub-scanning direction and be provided in a quantity equal to that of the plurality of nozzles for a single color. In so doing, it is possible to inspect for clogging in all nozzles for one color simultaneously. However, if ink droplets lp from adjacent nozzles were jetted simultaneously, then the two adjacent diaphragms 42*a* in question could interfere with each other, possibly resulting in misdetection. To prevent such misdetection, it is preferable for any two nozzles that are to be inspected simultaneously to be separated by a plurality of other, intervening nozzles that are not to be inspected at that instant.

In addition, although FIG. 1 shows two dot dropout detection units 40, 42, it is sufficient for a single printer to be provided with one dot dropout detection unit. Incidentally, the term "outward path," as used in this Description, refers to the path through which a carriage 28 travels while moving from the side where the dot dropout detection units 40, 42 are positioned (i.e., the standby position of the carriage 28) toward the other side; the term "return path," to the path through which the carriage travels while moving in the opposite direction.

C. Printing Procedure in the First Embodiment

Figure 6:
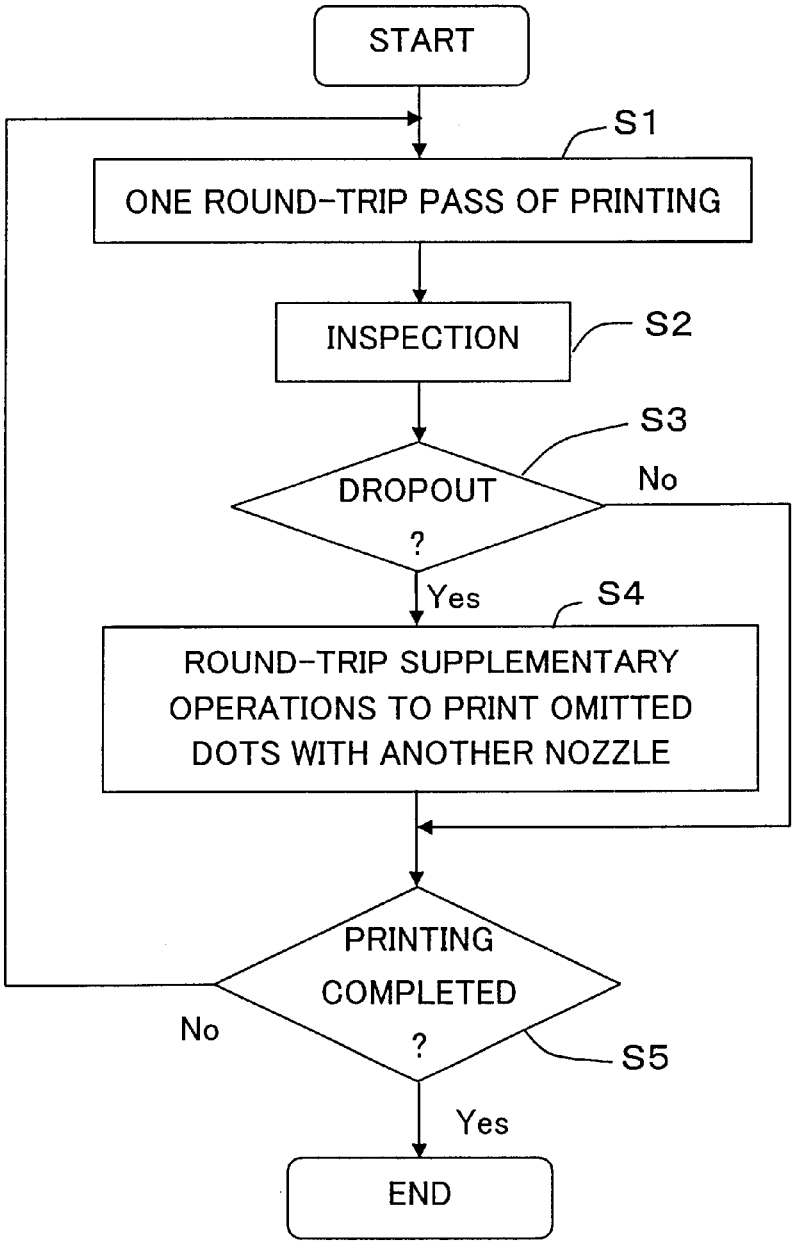
FIG. 6 is a flowchart showing the procedure of printing processing of the first embodiment.

FIG. 6 is a flowchart showing the procedure of printing processing of the first embodiment, in which dot dropout inspection is carried out upon the end of each round-trip movement. However, in the first embodiment, nozzle cleaning is not carried out, even when dot dropout is detected.

In Step 1, one round-trip pass of printing is carried out. In this Description, one main scanning during printing operations is referred to as a "pass." In the case of bidirectional printing, one main scan movement along the outward path is a single pass, and one main scan movement along the return path is also a single pass. However, the expression "one round-trip pass" includes one pass each along the outward path and return path. Upon the end of one round-trip pass of printing, dot dropout inspection for all nozzles for the six colors is carried out in Step S2 using the first dot dropout inspection unit 40. In the description that follows, use of the first dot dropout detection unit 40 is assumed unless specifically stated otherwise, although it is also possible to use the second dot dropout inspection unit 42 instead.

In Step S3, if no dot dropout is determined to have occurred, then the process proceeds to Step S5, and the determination as to whether printing of the entire page in question has been completed is made. If printing of the entire page has not been completed, then the process returns to Step S1.

If, in Step S3, dot dropout is determined to have occurred, then in Step S4, one round-trip pass of supplementary operations is carried out using another nozzle. More specifically, dots on a raster line where dot dropout occurred are printed with another, operational nozzle. Printing operations that are supplementary are hereinafter referred to as "supplementary operations"; printing operations for normal printing, as "normal printing operations."

Figure 7:
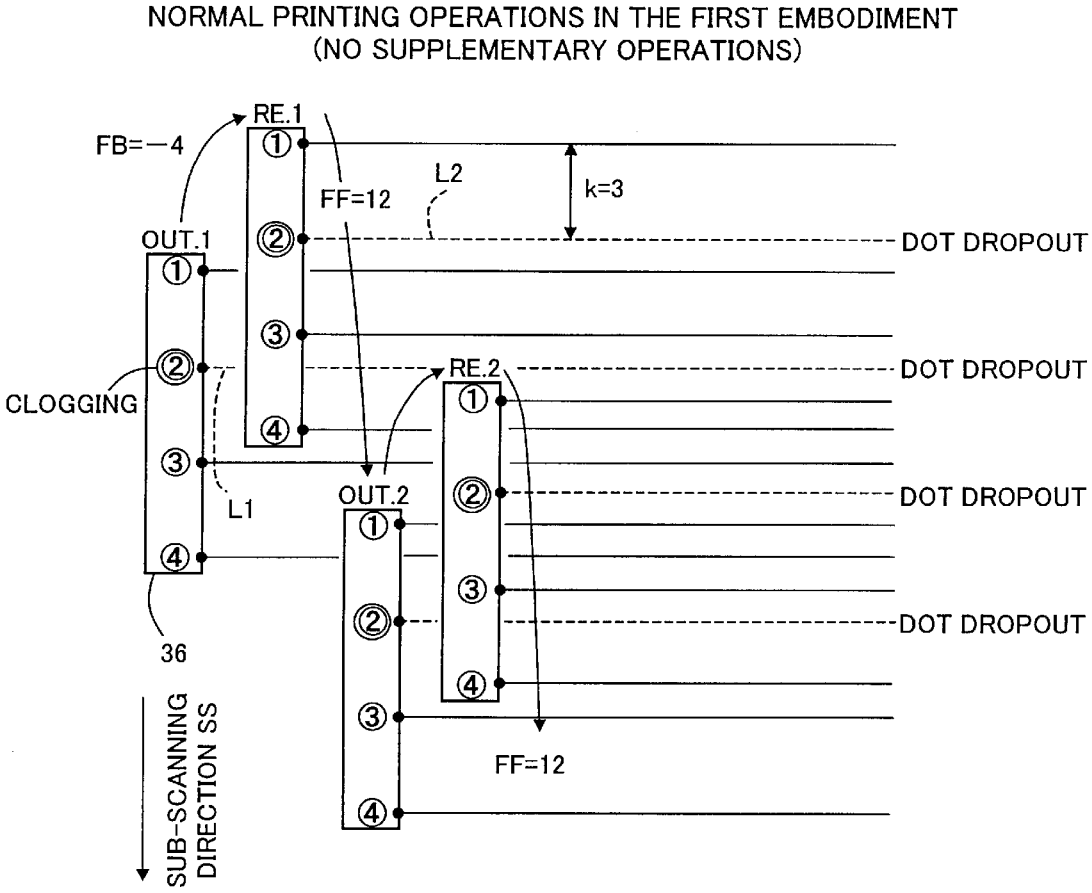
FIG. 7 is an explanatory drawing showing normal printing operations in the first embodiment.

FIG. 7 is an explanatory drawing showing printing operations that are carried out when no supplementation is carried out. In FIG. 7, which, for simplicity's sake, assumes a print head 36 having only four nozzles, the second nozzle is a non-operational nozzle (i.e., a clogged nozzle), and the other nozzles are all operational nozzles (i.e., nozzles that are not clogged). A nozzle pitch k of three dots is also assumed.

After an outward pass of normal printing operations, sub-scanning feeding by a distance equivalent to four dots is carried out in the direction opposite to the sub-scanning direction SS. Furthermore, after a return pass, sub-scanning feeding by an amount equivalent to 12 dots is carried out in the sub-scanning direction SS. Defining the value of the feed amount in the sub-scanning direction SS as a positive value, the feed amount FB after an outward pass is −4 dots, and the feed amount FF after a return pass is 12 dots. Feeding in the sub-scanning direction SS is also referred to as "forward feeding"; feeding in the direction opposite to the sub-scanning direction, as "back feeding." In the normal printing operations shown in FIG. 7, bidirectional printing alternates between forward feeding and back feeding upon each one-way main scanning. The advantages of such operations are discussed later.

In the example shown in FIG. 7, clogging of the second nozzle prevented printing of dots along two raster lines L1, L2 (represented by broken lines) in the first normal round-trip pass of printing. Unless supplementary operations are carried out, dots on those two raster lines L1, L2 will remain unformed, and further round-trip passes of printing subsequently will be carried out one after the other.

Figure 8:
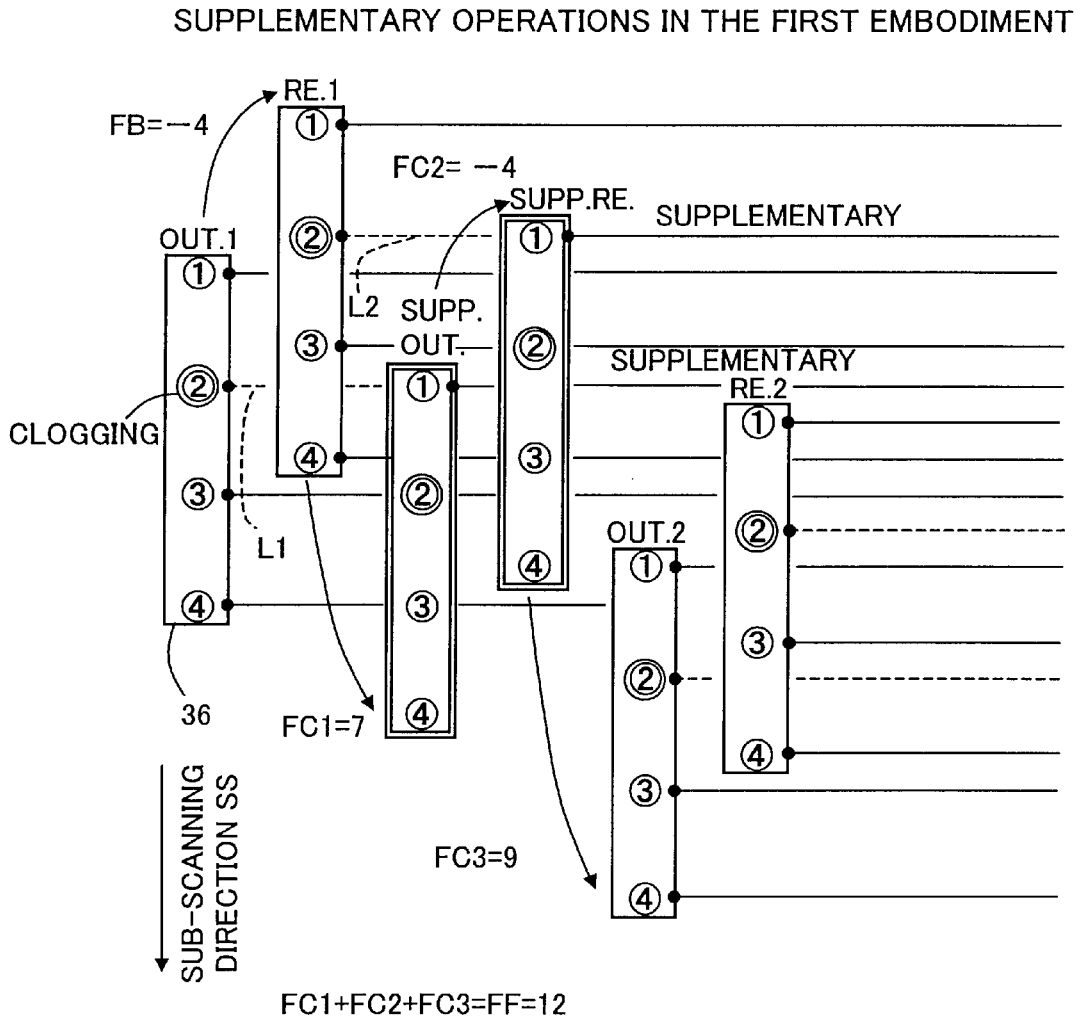
FIG. 8 is an explanatory drawing showing supplementary operations in the first embodiment.

FIG. 8 is an explanatory drawing of supplementary operations in the first embodiment. The dot dropout occurring in a first round-trip pass (including "OUT.1" and "RE.1") is the same as that shown in FIG. 7. However, because the inspection shown in Step S2 in FIG. 6 has detected the non-operational state of the second nozzle, the dot dropout occurring on raster lines L1 and L2 during the immediately preceding round-trip pass is also recognized. Therefore, in supplementary operations (i.e., Step S4) after the first round-trip pass, forward feeding by a temporary first feed amount FC1 is carried out to enable supplementary operations, positioning another, operational nozzle over raster line L1, on which dot dropout occurred in the first round-trip pass. In the example shown in FIG. 8, the temporary first feed amount FC1 is set at 7 dots, thereby positioning the first nozzle over raster line L1. In this state, one outward pass of printing is carried out using the first nozzle to print dots on raster line L1.

Next, back feeding by a temporary second feed amount is carried out to enable supplementary operations, positioning another, operational nozzle over raster line L2, where dot dropout occurred in the first return pass. In the example shown in FIG. 8, a temporary second feed amount FC2 is set a −4 dots, thereby positioning the first nozzle over raster line L2. In this state, one return pass of printing is carried out, using the first nozzle to print dots on raster line L2.

Further, to enable the above-described supplementary operations, printing data for one round-trip pass of normal printing are retained in an image buffer 52 (FIG. 2) after the normal printing is carried out, and supplementary operations are carried out using that portion of the printing data in the memory buffer that corresponds to the raster line on which dot dropout occurred. More specifically, the image buffer 52 retains, for each nozzle, two lines of printing data for an outward pass and a return pass. A round-trip pass of supplementary operations is also hereinafter referred to as a "supplementary round-trip pass."

In a supplementary round-trip pass, printing of only dots on a raster line on which dot dropout has occurred may be carried out, but printing of dots on other raster lines may also be carried out. More specifically, in a supplementary round-trip pass, it is sufficient to repeat printing of dots on at least one raster line that includes at least a raster line on which dot dropout has occurred. However, printing of only dots on a raster line on which dot dropout has occurred is carried out makes it possible to avoid unnecessary overprinting of dots on raster lines on which dots were printed properly and so offers the advantage of making possible greater image quality and the advantage of making it possible to conserve ink.

Upon the end of a supplementary round-trip pass, forward feeding is carried out by a temporary third feed amount FC3, moving the print head 36 so as to attain the position of the nozzles for a second round-trip pass of normal printing operations. As FIG. 8 shows, in the first embodiment, a forward feeding sub-scan is carried out before an outward main scanning pass of the supplementary operations; a back feeding sub-scan is carried out before a return main scanning pass of the supplementary operations; and a forward feeding sub-scan is carried out after a return main scanning pass of the supplementary operations (i.e., before an outward main scanning pass of the normal printing operations). As a result, in supplementary operations, as in normal printing operations, sub-scanning alternates between forward feeding and back feeding.

Three sub-scanning feeding operations by temporary feed amounts FC1 through FC3 are carried out between the first normal return pass and the second normal outward pass. If no dot dropout occurs, then the sub-scanning feeding that is carried out between the first normal return pass and the second normal outward pass is forward feeding by an amount FF (i.e., 12 dots), as shown in FIG. 7. Therefore, the three temporary sub-scanning feed amounts FC1–FC3 are set so that the sum thereof (i.e., FC1+FC2+FC3) is equal to the feed amount FF of sub-scanning feeding carried out between a normal return pass and a normal outward pass. In so doing, the print head 36 can be positioned appropriately for an outward pass of normal printing operations to be carried out after supplementary operations. Thus, supplementary operation is to be inserted between normal printing operations, without altering overall printing operations, making possible the resolution of dot dropout. In addition, control of the aforementioned supplementary operations is accomplished with a system controller 54.

Figure 9:
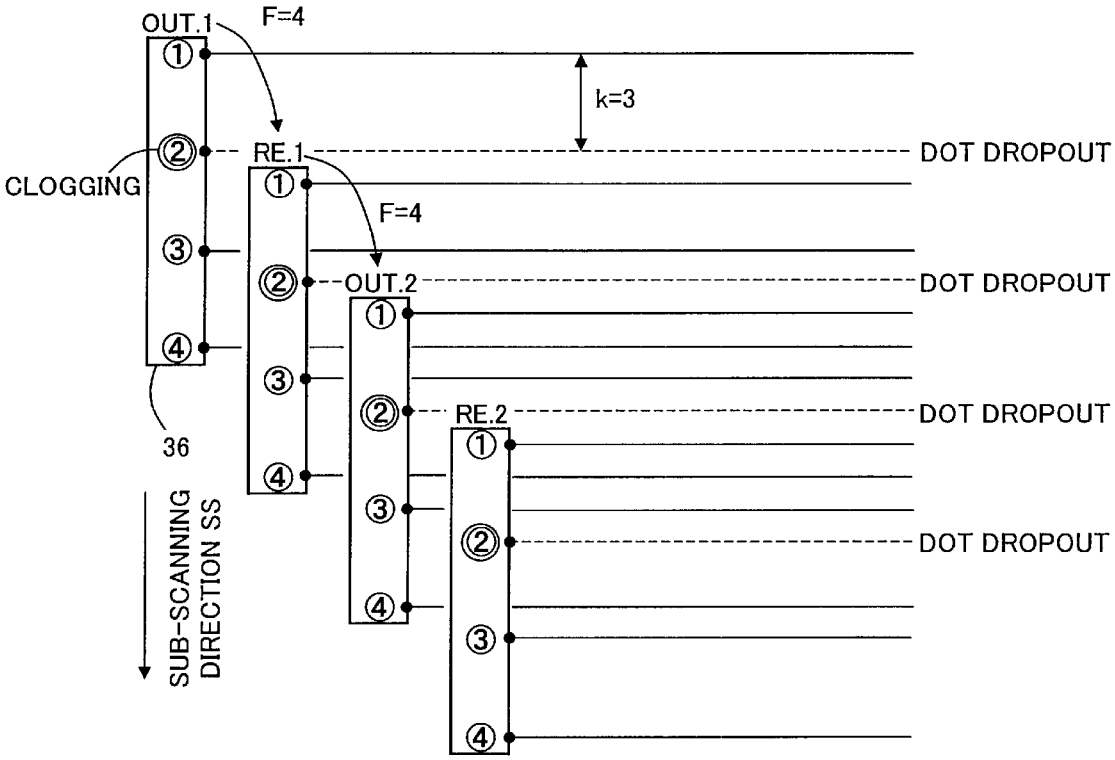
FIG. 9 is an explanatory drawing showing normal printing operations in the first embodiment.

FIG. 9 is an explanatory drawing showing normal printing operations in a comparative example that assumes that forward feeding by a fixed feed amount F (4 dots) is carried out after both an outward pass and a return pass and that, as in the first embodiment, clogging has occurred in the second nozzle. In addition, the comparative example also assumes that a dot dropout inspection unit 40 is provided at the standby position of the carriage and that dot dropout inspection and supplementary operations are carried out after each round-trip pass.

Figure 10:
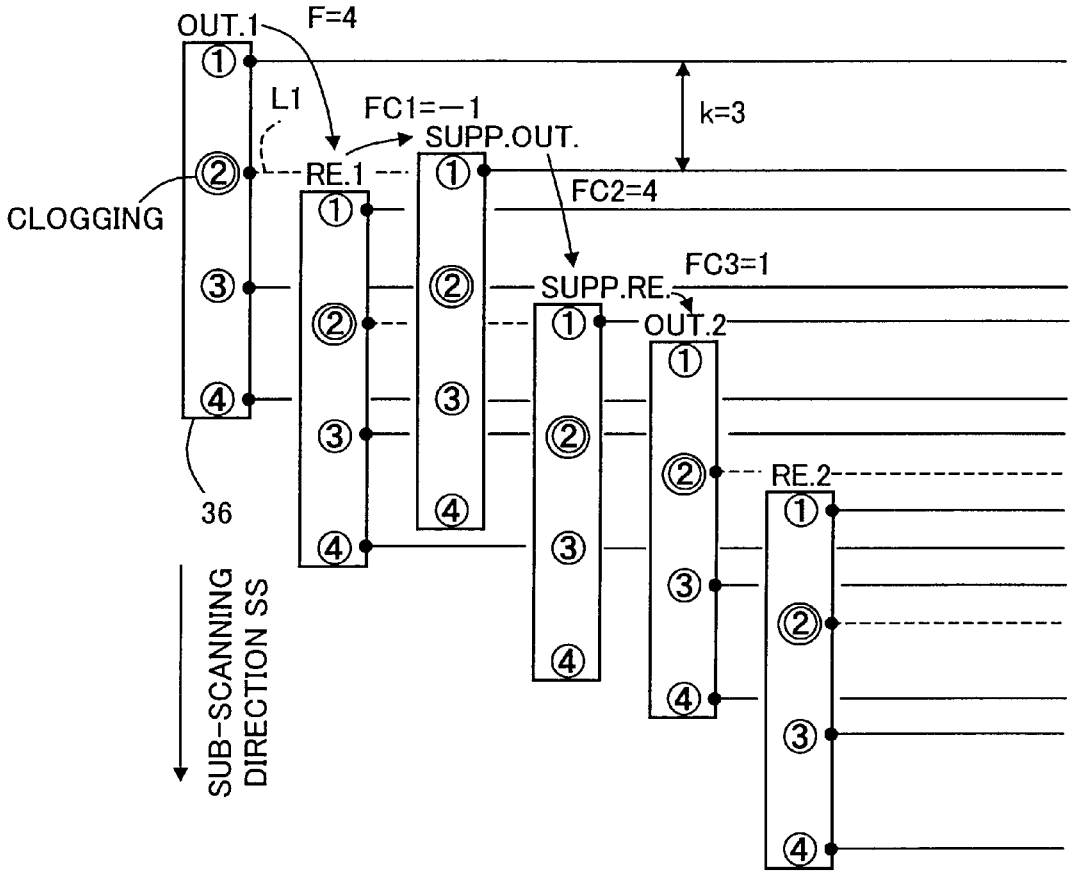
FIG. 10 is an explanatory drawing showing supplementary operations in a comparative example.

FIG. 10 is an explanatory drawing showing supplementary operations in the comparative example. The position of raster line L1, which was to have been printed by the second nozzle in a first normal outward pass, is lower in the sub-scanning direction than is the position in which the first nozzle is located during the first return pass ("RE.1"). However, the mechanical feed precision of sub-scanning drive mechanisms often differs greatly between forward feeding and back feeding. In the normal printing operations shown in FIG. 9, only forward feeding has been carried out, whereas in the supplementary operations shown in FIG. 10, both forward feeding and back feeding are carried out. Therefore, the supplementary operations shown in FIG. 10 may involve far greater feeding error in sub-scanning feeding than do the normal printing operations shown in FIG. 9. As a result, in the comparative example, carrying out supplementary operations can potentially result in greater sub-scanning feeding error and, therefore, in considerably lower image quality than would printing in which only normal printing operations were carried out.

In the first embodiment (shown in FIGS. 7 and 8), in contrast, forward feeding and back feeding are carried out alternately in both normal printing operations and supplementary operations, and so sub-scanning feeding error in supplementary operations is roughly equivalent to error in normal printing operations. A resultant advantage is the ability to mitigate the degradation in image quality that can result from increased sub-scanning feeding error during supplementary operations.

Figure 11:
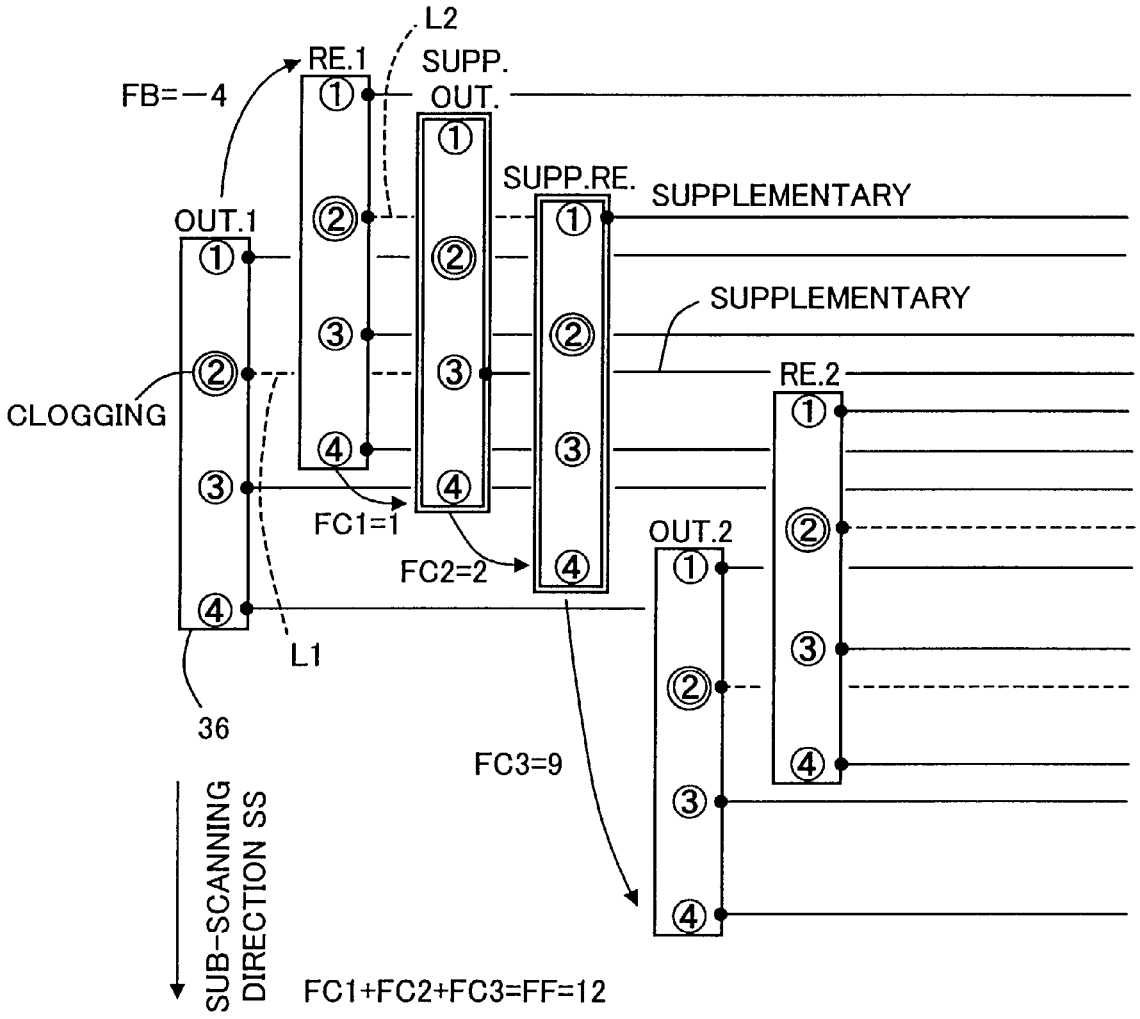
FIG. 11 is an explanatory drawing showing a variant example of supplementary operations in the first embodiment.

FIG. 11 is an explanatory drawing showing a variant example of supplementary operations in the first embodiment. The first difference with the supplementary operations shown in FIG. 8 concerns the selection of nozzles used to resolve dot dropout. Specifically, in the variant example shown in FIG. 11, supplementary operations are carried out using the operational nozzle that is located closest to the raster line where dot dropout occurred. For instance, when the print head 36 is positioned for the first return pass ("RE.1"), the operational nozzle that is closest to raster line L1, which is where dot dropout occurred during the first outward pass, is the third nozzle. Therefore, during the supplementary outward pass, supplementation of raster line L1 is carried out using the third nozzle. Similarly, when the print head 36 is positioned for the supplementary outward pass ("SUPP.OUT."), the operational nozzle closest to raster line L2, where dot dropout occurred during the first return pass, is the first nozzle. Therefore, during the supplementary return pass, supplementation of raster line L2 is carried out using the first nozzle.

As the above variant example shows, carrying out supplementary operations using the operational nozzle closest to the dot dropout-affected raster line when the print head 36 is in the position prior to temporary sub-scanning feeding makes it possible to reduce the absolute value of temporary feed amount. Because sub-scanning feeding error tends to decrease as the absolute value of feed amount decreases, selecting an operational nozzle for supplementary operations in the manner of the variant example can make it possible to reduce the feeding error of sub-scanning during supplementary operations.

Further, in the variant example shown in FIG. 11, temporary feed amounts FC1–FC3 are all positive values, and so in supplementary operations, only forward feeding is carried out, with no back feeding. When sub-scanning feeding error differs considerably between forward feeding and back feeding, it is preferable for temporary feeding in supplementary operations to alternate between forward feeding and back feeding, as shown in FIG. 8, than for only forward feeding to be carried out in supplementary operations, as in FIG. 11. On the other hand, when sub-scanning feeding error does not vary much between forward feeding and back feeding, then supplementary operations with a feed amount having a small absolute value, as shown in FIG. 11, are preferable.

Thus, in the first embodiment, sub-scanning during normal printing operations alternates between forward feeding and back feeding, and so even when back feeding is necessary during supplementary operations, sub-scanning feeding error during supplementary operations is roughly equivalent to that of normal printing operations. A resultant advantage is the ability to mitigate the degradation in image quality that can result from increased sub-scanning feeding error during supplementary operations.

D. Printing Procedure in the Second Embodiment

Figure 12:
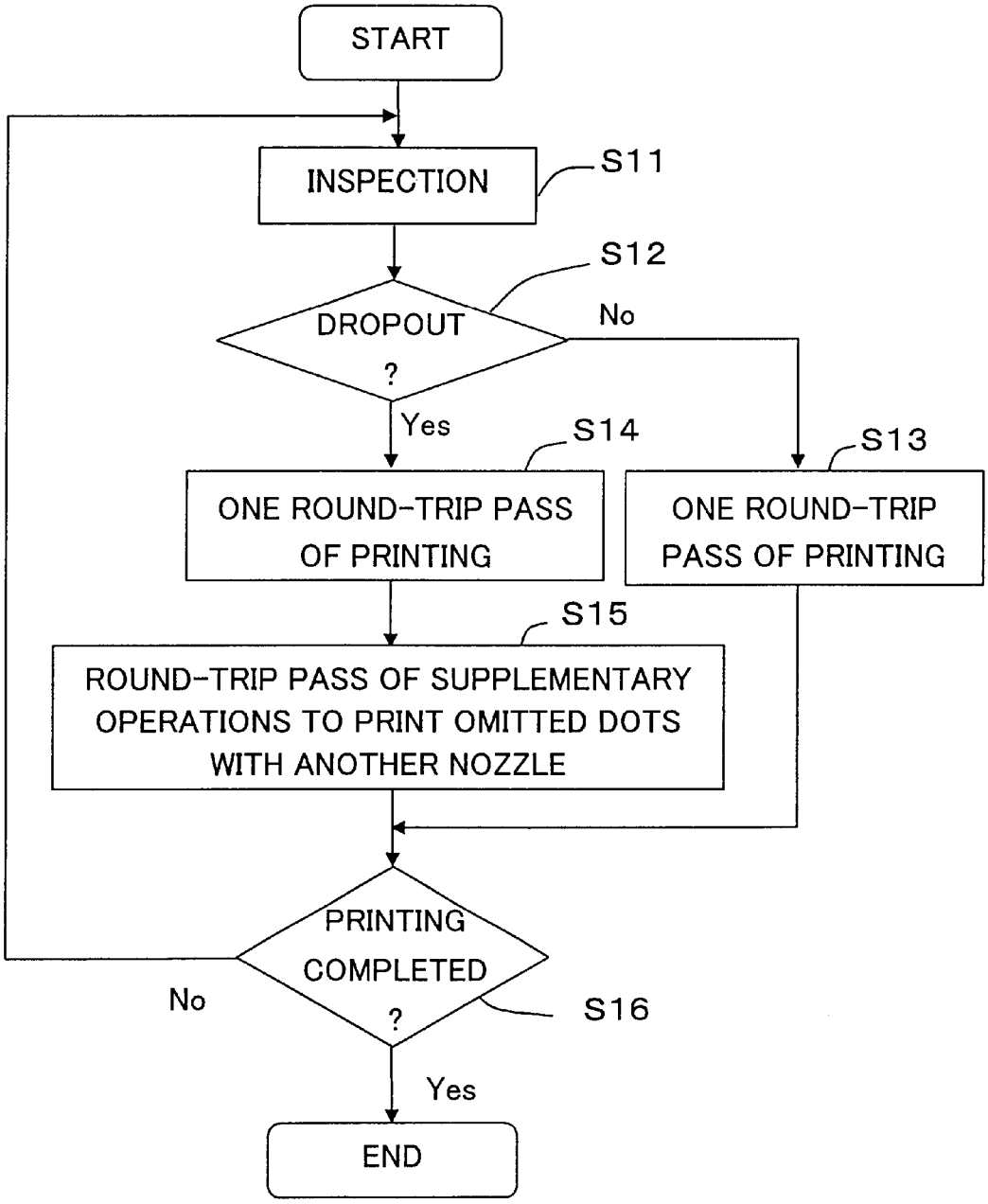
FIG. 12 is a flowchart showing the procedure of printing processing in a second embodiment.

FIG. 12 is a flowchart showing the procedure of printing processing in the second embodiment, in which dot dropout inspection is carried out before each round-trip main scan but in which nozzle cleaning is not carried out, even when dot dropout is detected.

First, in Step S11, with the carriage 28 in the standby position, the first dot dropout inspection unit 40 is used to carry out dot dropout inspection for all nozzles for the six colors. If, in Step S12, no dot dropout is determined to have occurred, then one round-trip pass of printing is carried out in Step S13. Upon the end of one round-trip pass of printing, determination as to whether printing of the entire page has been completed is made in Step S16. If printing of the entire page has not been completed, then the process returns to Step S11.

If, in Step S12, dot dropout is determined to have occurred, then, after one round-trip pass of printing is carried out in Step S14, supplementary operations wherein omitted dots are printed with other nozzles are carried out in Step S15. The supplementary operations are the same as the supplementary operations shown in FIGS. 8 and 11.

Upon the end of the supplementary round-trip pass, determination as to whether printing of the entire page has been completed is made in Step S16, and if printing of the entire page has not been completed, then the process returns to Step S11. Thus, even if dot dropout inspection is to be carried out before each round-trip pass, it is still possible to carry out printing while resolving dot dropout.

In the aforementioned first and second embodiments, dot dropout inspection is carried out upon each round-trip pass, and when dot dropout is detected, another, operational nozzle is used to carry out supplementary operations (i.e., a supplementary round-trip pass). Therefore, even if dot dropout occurs in a single round-trip pass, the dot dropout can be detected immediately and can be easily resolved on the printing medium.

E. Printing Procedure in the Third Embodiment

Figure 13:
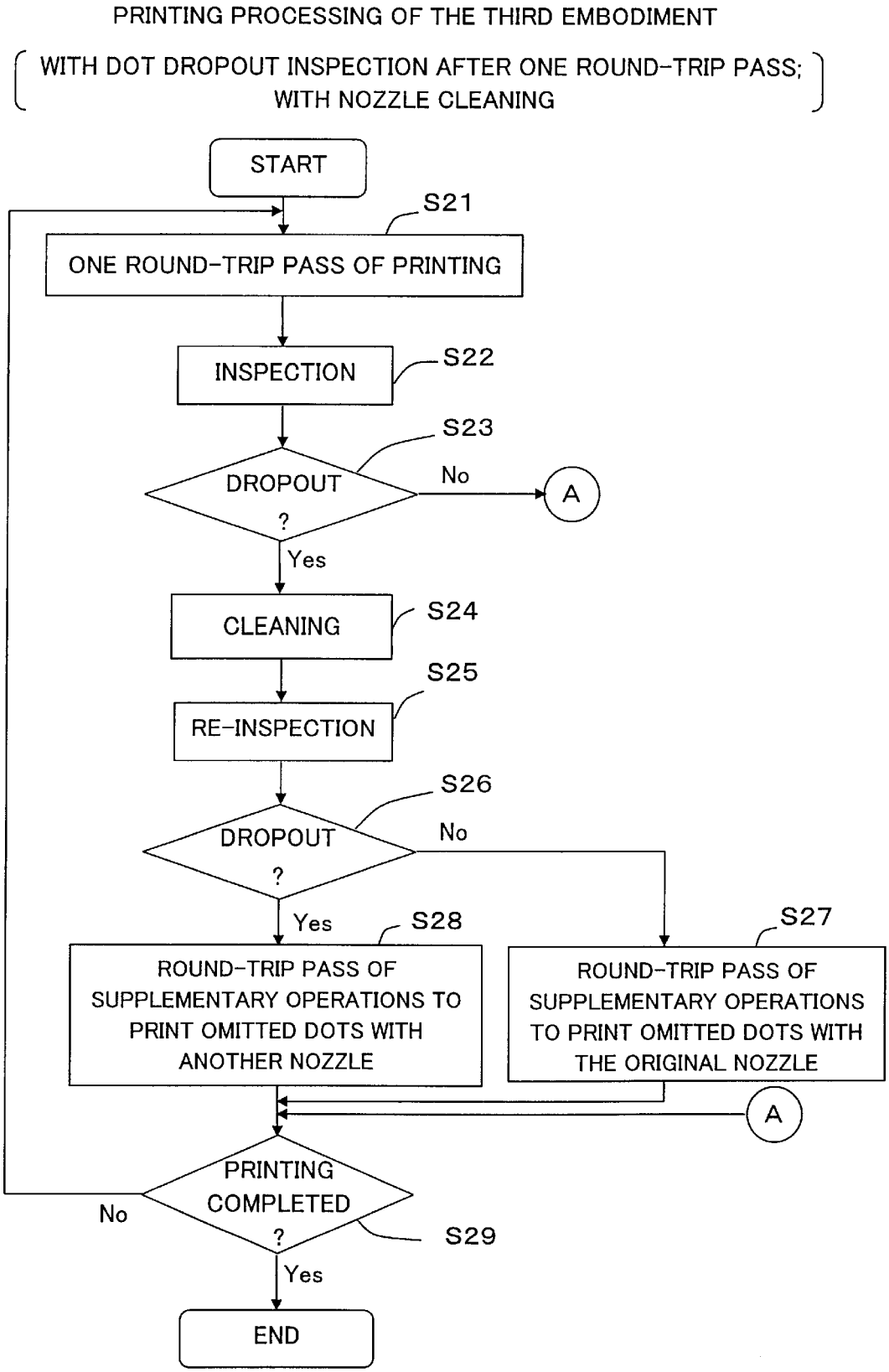
FIG. 13 is a flowchart showing the procedure of printing processing in a third embodiment.

FIG. 13 is a flowchart showing the procedure of printing processing in the third embodiment, in which dot dropout inspection is carried out after each round-trip main scan and nozzle cleaning is carried out when dot dropout is detected.

First, in Step S21, one round-trip pass of printing is carried out, and, in Step S22, dot dropout inspection is carried out. If, in Step S23, no dot dropout is determined to have occurred, the process proceeds to Step S29, and determination as to whether printing of the entire page has been completed is made. If printing of the entire page has not been completed, then the process returns to Step S21.

If, in Step S23, dot dropout is determined to have occurred, then, in Step S24, cleaning of the nozzles is carried out. The cleaning may involve cleaning of all nozzles of the print head 36 or cleaning of only those nozzles that are clogged.

In Step S25, dot dropout inspection is again carried out for all nozzles. In Step S26, if nozzle clogging is determined to have been resolved, the process proceeds to Step S27, and omitted dots are printed with the nozzles that were originally to have printed the dots.

Figure 14:
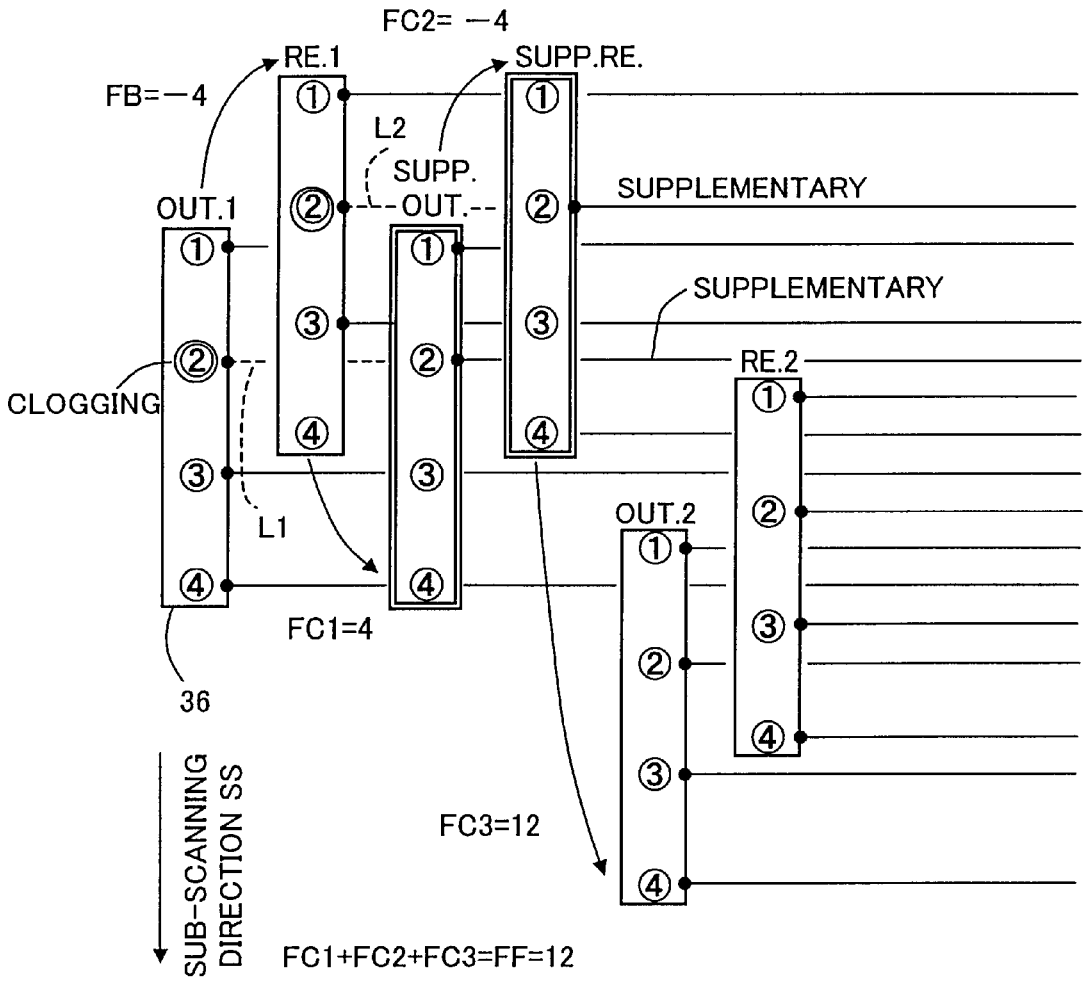
FIG. 14 is an explanatory drawing showing supplementary operations in Step S27 in the third embodiment.

FIG. 14 is an explanatory drawing showing supplementary operations in Step S27. In the supplementary outward pass, the print head 36 moves to the same position in which the print head 36 was located in the preceding normal outward pass. Further, in the supplementary return pass, as well, the print head 36 moves to the same position in which the print head 36 was located in the preceding normal return pass. To achieve this process, it is sufficient to set a temporary first feed amount FC1 at a value having the same absolute value as a normal back feed amount FB but having the opposite sign (i.e., plus sign or minus sign) and to set a temporary second feed amount FC2 having the same value as the normal back feed amount FB. In this case, as well, forward feeding and back feeding are carried out alternately in supplementary operations. Therefore, during supplementary operations such as those shown in FIG. 14, it is possible, just as in the supplementary operations of the first embodiment shown in FIG. 8, to mitigate the degradation in image quality arising from differences in sub-scanning feeding error between forward feeding and back feeding.

After dot dropout is resolved in Step S27, determination as to whether printing of the entire page has been completed is made in Step S29, and if printing of the entire page has not been completed, then the process returns to Step S21.

However, if it is determined in Step S26 that nozzle clogging has not been resolved, then supplementary operations using another nozzle are carried out in Step S28. More specifically, dots on the raster line where dot dropout occurred are printed with another, operational nozzle. The supplementary operations are the same as the aforementioned supplementary operations shown in FIGS. 8 and 11. After the supplementary operations, determination as to whether printing of the entire page has been completed is made in Step S29, and if printing of the entire page has not been completed, then the process returns to Step S21.

Thus, carrying out nozzle cleaning when dot dropout is detected by dot dropout inspection offers the advantage of making it possible, if nozzle operation has been restored, to carry out dot supplementation using the nozzle that was originally to have printed the raster line on which dot dropout occurred.

Further, if a raster line on which dot dropout occurred is supplemented using another, operational nozzle, the numerical sequence of nozzles assigned to print adjacent raster lines will differ from that of other portions of the image to be printed. Because of a slight positional difference in dots printed by a given nozzle relative to dots printed by other nozzles, a difference in the numerical sequence of nozzles assigned to print adjacent raster lines results in a difference in the pattern of the positional difference. As a result, degradation in image quality can occur. Therefore, it is preferable, with respect to image quality, to carry out cleaning when dot dropout is detected and to carry out supplementary operations using the nozzles that were originally to have printed the omitted dots.

F. Printing Procedure in the Fourth Embodiment

Figure 15:
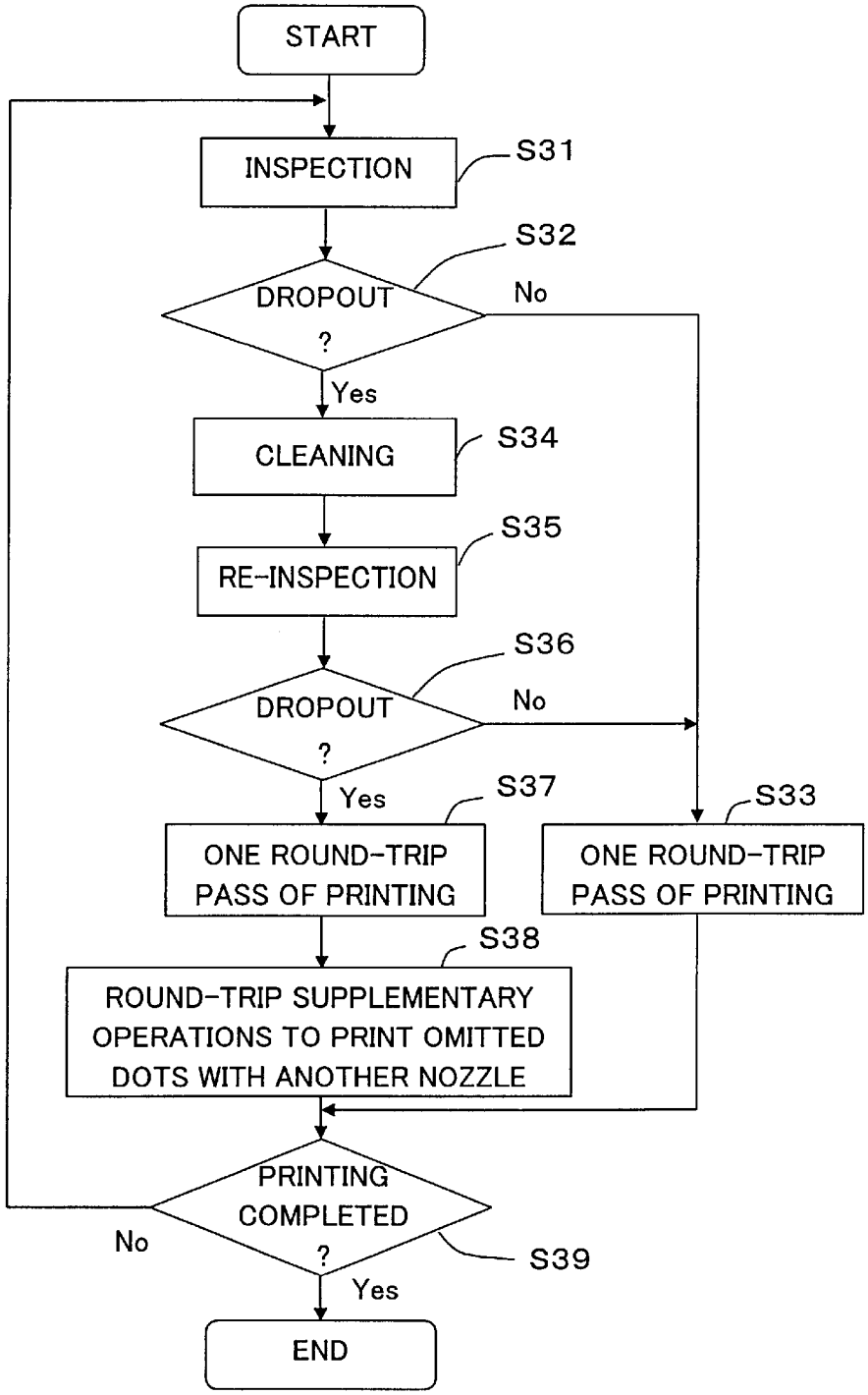
FIG. 15 is a flowchart showing the procedure of printing processing in a fourth embodiment.

FIG. 15 is a flowchart showing the procedure of printing processing of the fourth embodiment, in which dot dropout inspection is carried out before each round-trip main scan and in which nozzle cleaning is carried out when dot dropout is detected.

First, dot dropout inspection is carried out in Step S31. If, in Step S32, no dot dropout is determined to have occurred, then, in Step S33, one round-trip pass of printing is carried out. Upon ending of one round-trip pass of printing, determination as to whether printing of the entire page has been completed is made in Step S39, and if printing of the entire page has not been completed, then the process returns to Step S31.

If, in Step S32, dot dropout is determined to have occurred, cleaning of nozzles is carried out in Step S34. In Step S35, dot dropout inspection is again carried out for all nozzles. In Step S36, if nozzle clogging is determined to have been resolved, the process proceeds to Step S33 and one round-trip pass of printing is carried out, after which the process proceeds to Step S39. However, if nozzle clogging is determined not to have been resolved, then, after one round-trip pass of printing is carried out in Step S37, supplementary operations in which omitted dots are printed with other nozzles is carried out in Step S38. The supplementary operations are the same as those shown in FIGS. 8 and 11.

Upon the end of a supplementary round-trip pass, determination as to whether printing of the entire page has been completed is made in Step S39, and if printing of the entire page has not been completed, then the process returns to Stop S31.

In the aforementioned third and fourth embodiments, dot dropout inspection is carried out upon each round-trip pass, nozzle cleaning is carried out when dot dropout is detected, and, when cleaning fails to restore nozzle operation, supplementary operations are carried out with another, operational nozzle. Further, as shown in FIG. 13, when dot dropout inspection is carried out after a round-trip pass and nozzle operation has been restored by cleaning, supplementary operations are carried out using the restored nozzle that was originally to have printed the omitted dots. Therefore, even if dot dropout occurs in a single round-trip pass, the dot dropout can be detected immediately and can be easily corrected on the printing medium.

As described above, in the first and fourth embodiments, sub-scanning during normal printing operations alternates between forward feeding and back feeding, and so even when back feeding is necessary during supplementary operations, sub-scanning feeding error at a raster line on which supplementary operations are carried out is not excessively greater than the error elsewhere. A resultant advantage is the ability to mitigate the degradation in image quality that can result from increased sub-scanning feeding error. This effect is particularly pronounced when, as shown in FIG. 8, sub-scanning also alternates between forward feeding and back feeding during supplementary operations.

The present invention is not limited to the above-described embodiments or embodiments, but rather can be implemented in various other modes to the extent that the applications do not depart from the scope of the invention. For instance, variations such as the following are also possible.

(1) Part of a configuration achieved by means of hardware in the above embodiments may be replaced with software, or, conversely, part of a configuration achieved by means of software may be replaced with hardware.

(2) The present invention is, in general, applicable to printing apparatus of types that jet ink droplets, and is also applicable to various printing apparatus other than color inkjet printers. For instance, the present invention is also applicable to inkjet-type facsimile machines and copier machines.

(3) In the third embodiment, when one cleaning fails to resolve nozzle clogging, supplementary operations are carried out using another nozzle, but supplementary operations using the other nozzle may be carried out only if nozzle clogging fails to be resolved by two or more cleanings. More specifically, when the nozzle clogging is cleared within a predetermined number of cleanings, supplementary operations may, in general, be carried out with the nozzle that was originally to have printed the omitted dot in question, and supplementary operations may be carried out with another nozzle if nozzle clogging fails to be cleared even after the predetermined number of cleanings.

In addition, in the fourth embodiment, supplementary operations may be carried out when nozzle clogging fails to be cleared even after a predetermined number of cleanings.

(4) Among printing media, there are some on which dot dropout is prominent, others on which dot dropout is less prominent. For instance, dot dropout on inkjet printing paper is prominent, whereas dot dropout on normal copier paper is less prominent. Therefore, when a printing medium on which dot dropout is less prominent is used, supplementary operations may be deferred until a predetermined number of nozzles becomes clogged. In so doing, it is possible to prevent degradation in image quality without reducing printing speed very much.

(5) Among types of images that are printed, there are those wherein dot dropout is prominent and others wherein dot dropout is less prominent. For instance, dot dropout in a photographic image is prominent, whereas dot dropout is less prominent in images that contain only text and graphic images comprising a combination of text and graphs or other graphics. In this Description, photographic images, graphic images, and other images to be printed that do not contain photographs are referred to as "non-photographic images." When printing such non-photographic images, supplementary operations may be deferred until a predetermined number of nozzles becomes clogged. Further, when thus adjusting supplementary operations according to the type of image to be printed, information specifying the type of image to be printed may be stored, for instance, in the header of printing data that are sent from a computer to printer.

(5) Among printing modes, there are also those wherein dot dropout is prominent and those wherein dot dropout is less prominent. For instance, there are printing modes wherein only one-fourth of all pixels of a plurality of raster lines are printed in a single pass, and so four passes are required to print all pixels of the raster lines. The greater the number of passes is, the less prominent dot dropout tends to be. Therefore, when the number of passes necessary to print all pixel positions on a raster line is equal to or greater than a predetermined number, supplementary operations may be deferred until a predetermined number of nozzles becomes clogged.

(6) When dot dropout is detected within a predetermined area close to an end of the printing area of a printing medium, supplementary operations using another nozzle may be initiated immediately, without carrying out cleaning. For instance, in a portion of a sheet of printing paper equivalent to approximately the last third or fourth, supplementary operations may be carried out without carrying out cleaning. In so doing, it may be possible to shorten printing time.

INDUSTRIAL APPLICABILITY

The present invention is applicable to printers, facsimile machines, and other apparatus that jet ink from nozzles.

What is claimed is:

1. A method for printing by jetting ink droplets from a plurality of nozzles during an outward pass and a return pass of main scanning, comprising the steps of:

(a) executing bidirectional normal printing operations wherein a forward feeding sub-scan and a back feeding sub-scan are alternately carried out between the outward pass and the return pass of main scanning;

(b) executing, for each round-trip pass of normal printing operations, a dot dropout inspection which detects whether ink droplets are jetted from each nozzle in order to determine whether each nozzle is an operational nozzle capable of jetting ink droplets or a non-operation nozzle incapable of jetting ink droplets; and (c) executing, when a non-operational nozzle is present, supplementary operations wherein dots which would have been printed by the non-operational nozzle are printed using an operational nozzle in a round-trip pass.

2. A printing method recited in claim 1, wherein step (a) includes the steps of:

forward feeding a first feed amount before the outward pass of main scanning in the normal printing operations, and back feeding a second feed amount which is less than the first feed amount before the return pass of main scanning in the normal printing operations.

3. A printing method recited in claim 2, wherein step (c) includes the stes of:

forward feeding sub-scan before an outward pass of main scanning in the supplementary operations;

back feeding before a return pass of main scanning in the supplementary operations; and forward feeding after a return pass of main scanning in the supplementary operations but before an outward pass of main scanning in the normal printing operations.

4. A printing method recited in claim 1, wherein step (c) includes the step of printing using the operational nozzle only dots on a main-scanning line that were to have been printed by the non-operational nozzle.

5. A printing method recited in claim 1, further comprising the step of:

cleaning at least the non-operational nozzle between step (b) and (c) if the non-operational nozzle is detected in step (b), wherein step (c) further includes the step of carrying out first supplenentary operations wherein dots which would have been printed with the non-operational nozzle are printed with the operational nozzle if a predetermined number of the cleanings fail to restore operation of the non-operational nozzle.

6. A printing method recited in claim 5, wherein step (c) further includes the step of carrying out second supplementary operations wherein dots which would have been printed with the non-operational nozzle are printed with the non-operational nozzle if operation of the non-operational nozzle is restored within a predetermined number of cleanings.

7. An apparatus for printing by jetting ink droplets from a plurality of nozzles during an outward pass and a return pass of main scanning, comprising:

a normal printing operation execution section configured to execute bidirectional normal printing operations wherein a forward feeding sub-scan and a back feeding sub-scan are alternately carried out between the outward pass and return pass of main scanning;

a detection unit configured to execute, for each round-trip pass of normal printing operations, a dot dropout inspection that detects whether ink droplets are jetted from each nozzle in order to determine whether each nozzle is an operational nozzle capable of jetting ink droplets or a non-operational nozzle incapable of jetting droplets; and a supplementary operation execution section configured to execute, when a non-operational nozzle is present, supplementary operations wherein dots which would have been printed by the non-operational nozzle are printed using an operational nozzle in a round-trip pass.

8. A printing apparatus recited in claim 7, wherein the normal printing operation execution section carries out the forward feeding sub-scan by a first feed amount before the outward pass of main scanning in the normal printing operations, and carries out the back feeding sub-scan by a second feed amount that is less than the first feed amount before the return pass of main scanning in the normal printing operations.

9. A printing apparatus recited in claim 8, wherein the supplementary operation execution section carries out a forward feeding sub-scan before an outward pass of main scanning in the supplementary operations, carries out a back feeding sub-scan before a return pass of main scanning in the supplementary operations; and carries out a forward feeding sub-scan after a return pass of main scanning in the supplementary operations but before an outward pass of main scanning in the normal printing operations.

10. A printing apparatus recited in claim 7, wherein the supplementary operations are operations wherein only dots on a main-scanning line that were to have been printed by a non-operational nozzle are printed using the operational nozzle.

11. A printing apparatus recited in claim 7, further comprising a cleaning execution unit configured to execute cleaning of at least the non-operational nozzle before the supplemental operations if the non-operational nozzle is detected by the detection unit, wherein the supplementary operation execution section includes a first supplementary operation execution section configured to carry out first supplementary operations wherein dots which would have been printed with the non-operational nozzle are printed with the operational nozzle if a predetermined number of the cleanings fail to restore operation of the non-operational nozzle.

12. A printing apparatus recited in claim 11, wherein the supplementary operation execution further includes a second supplementary operation execution section configured to carry out second supplementary operations wherein dots which would have been printed with the non-operational nozzle are printed with the non-operational nozzle if operation of the non-operational nozzle is restored within a predetermined number of cleanings.

13. A computer program product that includes a computer program for causing a computer to carry out printing, the computer having an apparatus for printing by jetting ink droplets from a plurality of nozzles during an outward pass and a return pass of main scanning, the computer program product comprising:

a computer-readable storage medium; and a computer program stored on the computer-readable storage medium, the computer program including:

a first computer program configured to detect for each round-trip pass of bidirectional normal printing operations wherein a forward feeding sub-scan and a back feeding sub-scan are alternately carried out between the outward pass and return pass of main scanning, whether ink droplets are jetted from each nozzle in order to determine whether each nozzle is an operational nozzle capable of jetting ink droplets or a non-operational nozzle incapable of jetting ink droplets; and a second computer program configured to carry out supplementary operations when a non-operational nozzle is present, wherein dots which would have been printed by the non-operational nozzle are printed using the operational nozzle in a round-trip pass.

* * * * *